US010714274B2

(12) United States Patent
Bianco et al.

(10) Patent No.: US 10,714,274 B2
(45) Date of Patent: Jul. 14, 2020

(54) MEDIUM VOLTAGE CIRCUIT SWITCH OR BREAKER

(71) Applicant: ABB Schweiz AG, Baden (CH)

(72) Inventors: Andrea Bianco, Sesto San Giovanni (IT); Christian Reuber, Willich (DE); Francesco Belloni, Bergamo (IT); Juhani Koivupuro, Vaasa (FI); Luciano Chenet, Torre Boldone (IT)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 16/226,711

(22) Filed: Dec. 20, 2018

(65) Prior Publication Data

US 2019/0148087 A1 May 16, 2019

Related U.S. Application Data

(63) Continuation of application No. PCT/EP2017/065834, filed on Jun. 27, 2017.

(30) Foreign Application Priority Data

Jun. 27, 2016 (EP) ..... 16176512

(51) Int. Cl.
*H01H 39/00* (2006.01)
*H01H 3/24* (2006.01)
(Continued)

(52) U.S. Cl.
CPC ..... *H01H 3/24* (2013.01); *H01H 3/22* (2013.01); *H01H 3/30* (2013.01); *H01H 3/38* (2013.01);
(Continued)

(58) Field of Classification Search
CPC .. H01H 39/00; H01H 2039/008; H01H 85/08; H01H 39/006; H01H 9/106; H01H 2219/054; H01H 71/0207; H01H 71/08; H01H 79/00; H01H 85/0241; H01H 85/306; H01H 85/38; H01H 9/02; H01H 9/102;
(Continued)

(56) References Cited

U.S. PATENT DOCUMENTS 3,624,329 A 11/1971 Fischer et al.
3,748,418 A 7/1973 Kawasaki
(Continued)

FOREIGN PATENT DOCUMENTS

AU 2002344034 A1 7/2003
CN 1417818 A 5/2003
(Continued)

*Primary Examiner* — Ahmed M Saeed
(74) *Attorney, Agent, or Firm* — Leydig, Voit & Mayer, Ltd.

(57) ABSTRACT

A medium voltage circuit switch or breaker includes: at least one movable contact; a fixed contact; and a mechanical or magnetical drive system, which moves the at least one movable contact to a closed or opened position by a movement of a rod and/or a lever. The mechanical or magnetical drive system is linked to a switching generating signal. The mechanical or magnetical drive system includes at least one pyrotechnical actuator or gas generator. The pyrotechnical actuator or the gas generator is linkable to the switching generating signal of the mechanical or magnetical drive system.

15 Claims, 4 Drawing Sheets

(51) Int. Cl.

| | |
|---|---|
| ***H01H 33/32*** | (2006.01) |
| ***H01H 3/22*** | (2006.01) |
| ***H01H 3/30*** | (2006.01) |
| ***H01H 3/38*** | (2006.01) |
| ***H01H 3/46*** | (2006.01) |
| *H01H 33/38* | (2006.01) |
| *H01H 33/666* | (2006.01) |
| *H01H 33/28* | (2006.01) |

(52) U.S. Cl.
CPC ..... *H01H 3/46* (2013.01); *H01H 33/32* (2013.01); *H01H 39/00* (2013.01); *H01H 33/28* (2013.01); *H01H 33/38* (2013.01); *H01H 2033/6667* (2013.01)

(58) Field of Classification Search
CPC ..... H01H 9/30; H01H 9/54; H01H 2089/005; H01H 3/28; H01H 71/12; H01H 89/08
See application file for complete search history.

(56) References Cited

U.S. PATENT DOCUMENTS

| | | | | |
|---|---|---|---|---|
| 5,567,923 | A | 10/1996 | Perret | |
| 2010/0027182 | A1 | 2/2010 | Lindeperg et al. | |
| 2010/0181182 | A1 | 7/2010 | Gentsch et al. | |
| 2012/0048699 | A1* | 3/2012 | Almgren ..... | H01H 1/34<br>200/468 |
| 2016/0056710 | A1* | 2/2016 | Hafner ..... | H02M 1/32<br>363/53 |

FOREIGN PATENT DOCUMENTS

| | | | |
|---|---|---|---|
| CN | 101069255 | A | 11/2007 |
| CN | 101689440 | A | 3/2010 |
| CN | 201655657 | U | 11/2010 |
| DE | 3006336 | A1 | 8/1981 |
| DE | 4209167 | A1 | 9/1993 |
| EP | 0667633 | A1 | 8/1995 |
| EP | 0740322 | A2 | 10/1996 |
| FR | 2023557 | A1 | 8/1970 |
| JP | 2010080412 | A | 4/2010 |

* cited by examiner

MEDIUM VOLTAGE CIRCUIT SWITCH OR BREAKER

CROSS-REFERENCE TO PRIOR APPLICATION

This application is a continuation of International Patent Application No. PCT/EP2017/065834, filed on Jun. 27, 2017, which claims priority to European Patent Application No. EP 16176512.8, filed on Jun. 27, 2016. The entire disclosure of both applications is hereby incorporated by reference herein.

FIELD

The invention relates to a medium voltage circuit switch or breaker with at least one moved contact and a fixed contact, and a mechanical or magnetical drive system, which moves the fixed contact in closed or opened position, wherein the mechanical or magnetical drive system is linked to a switching generating signal, and method of operating the same.

BACKGROUND

A medium voltage circuit breaker is a key component of a power plant, that is called to operate under different conditions, for example frequently switching load condition and very rarely under fault condition.

One of the most important key point for the system and for the customers is its reliability. A correct approach is going towards monitoring and diagnostic functions, that allows predicting system malfunction, scheduling preventive maintenance reducing impact on the supplied network and/or process.

In the state of the art, it is well known to use redundant switches in parallel, in order to take care of a safe switching operation. In DE 42 09 167 A1 is disclosed a semiconductor switch in parallel to a circuit breaker.

A further problem is, that even if in some cases, the diagnostic can be really advanced, there could be some limitation on this approach.

It is very difficult to perform a diagnostic so deep, especially in standard circuit breaker, to be able to check the full integrity of the apparatus.

This limitation is present in both, the main technologies used today with different way—magnetic actuator and mechanics actuator—because both systems are bistable.

This implies, that in order to test really the Open functionality of the actuator, it is needed to open the circuit breaker, and in order to test the Close functionality, it is needed to Close the circuit breaker.

Often, especially if the circuit breaker is used as protection and not as Load Switch in the process, it is rarely operated. This condition reduces deeply the possibility to capture data related to the status apparatus, for example switching time, travel curve and so on, because the breaker can't be opened in order to test that in case of failure it will Open the circuit.

One alternative approach can be, to perform redundancies in the power plant, having different level of protections, in different circuit breaker, coordinated between them. This approach, even if effective, leads to very high costs, engineering and space requirement.

SUMMARY

In an embodiment, the present invention provides a medium voltage circuit switch or breaker, comprising: at least one movable contact; a fixed contact; and a mechanical or magnetical drive system, which is configured to move the at least one movable contact to a closed or opened position by a movement of a rod and/or a lever, the mechanical or magnetical drive system being linked to a switching generating signal, wherein the mechanical or magnetical drive system comprises at least one pyrotechnical actuator or gas generator, and wherein the pyrotechnical actuator or the gas generator is linkable to the switching generating signal of the mechanical or magnetical drive system.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
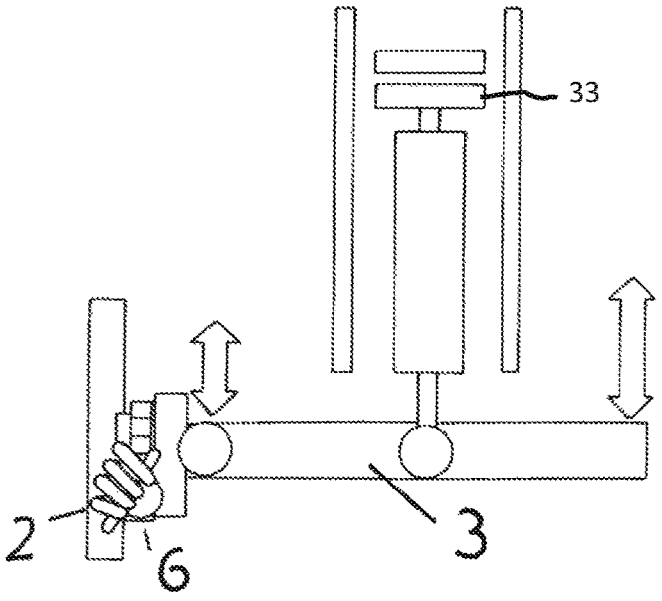
FIG. 1 shows the implementation of the invention in such, that a circuit breaker is provided with an ADDITIONAL pyrotechnical actuator or gas generator.

Considering that, the object of the invention is, to provide a redundant actuation system which is cost effective and performing a smart TRIP function.

The invention is, that additionally to the mechanical or magnetical drive system, the mechanical or magnetical drive system is provided with at least one pyrotechnical actuator or gas generator, and that the pyrotechnical actuator or gas generator is linkable to the same switching generating signal of the mechanical or magnetical drive system.

Considering this feature combination, it is important, that at first the circuit breaker is provided additionally with the pyrotechnical actuator or gas generator, and that secondly, the circuit breaker is linked in such to the same switching generating signal of the drive system, because, by that, the malfunction only shifts the actuation moment, but not the actuation a such.

A time shift might be caused by the electronic diagnosis time, need for detecting the malfunction of the mechanical or magnetical drive. So it is an active redundant system.

But nevertheless, the actuation moment shift can be reduced to zero, if the malfunction of the mechanical or magnetical drive can be automatically detected by predictive automatic analysis, for example by predictive micromotion activation or a so called partial stroke, before the regular switching process is intended to be generated.

In a further advantageous embodiment, that the pyrotechnical actuator or gas generator is driven as redundant actuation system, in such, that in a logical unit, in case of detection of a malfunction of the mechanical or magnetical drive, the pyrotechnical actuator or gas generator is ignited instead, as redundant trip function.

In a further advantageous embodiment, the additional pyrotechnical actuator is limited on a pyrotechnical capsule with an extending mechanical element and a signal for ignition.

Furthermore advantageous is, that in the logical unit are stored analytical data of a set of possible malfunctions of the mechanical or magnetical drive, in order to create dynamically adapted ignition signals for the pyrotechnical actuator or gas generator. By that, several signals or signal characteristics are available, just in case, in order to prevent long calculation time induced delays.

In a further advantageous embodiment, the pyrotechnical actuator or gas generator is arranged near the aforesaid rod and/or lever, in such, that the expansion force vector of the pyrotechnical actuator or gas generator is oriented in parallel to the actuation vector of the aforesaid rod or lever.

In a further advantageous embodiment, the pyrotechnical actuator or gas generator is sampled in a functional assembly, which can be mounted directly on the functionally effective location, like said in the aforesaid medium voltage circuit breaker, by retrofit.

The main focus of the invention is, to use this technology in order to provide a safe and redundant switching mechanism to be used in case of the main drive failed the operation due to a system malfunction. Additionally the introduction of completely different technology is an added value also in order to avoid any common mode failures.

It has to be considered that the pyrotechnic actuator can operate the breaker only once. The unit has to be replaced to re-establish the same protection quality that was available before the pyrotechnic operation. It is therefore a safety feature that the circuit breaker cannot be closed before manual inspection and replacement of the pyrotechnic operation unit.

It can be an additional safety feature to design the circuit breaker in a way that it cannot be closed without a pyrotechnic actuator in place, to avoid a situation where the original protection quality is not present.

The idea or replacing the pyrotechnic operation unit implies certainly that the circuit breaker shall be designed in a way that it will not be damaged in any way due to the operation of the pyrotechnic actuator. Further, the design of the circuit breaker has to enable an easy and fail-safe replacement of the pyrotechnic unit.

This tripping mechanism could be applied in different ways in the system, but in order to provide a real effective and simple function, the proposal is to implement it very close to the switched element as proposed in the detailed description below.

In normal condition the hub provided by the mechanism is fixed as in a standard circuit breaker. In this normal operation the circuit breaker is operated by the main mechanic or magnetic drive.

In case of failure of the main drive during a TRIP event, a request with a second electrical pulse, delayed and coming from the relay or from an internal intelligence of the circuit breaker is sent to the pyrotechnic actuator. In few milliseconds the gas expansion inside the actuator, provides a pulse of force able to collapse down the hub of the fixed rod performing a safe open function.

Figure 3:
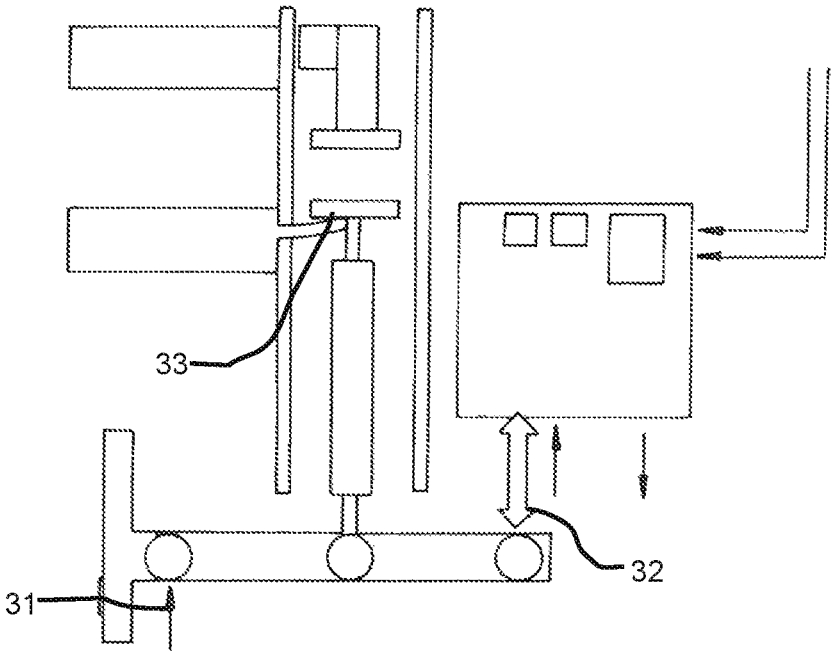
FIG. 3 shows a medium voltage switch, with a parallel drive, which actuates the movement of the movable contact via a lever, which is pivotable by a fixed hub.

FIG. 3 shows a medium voltage switch, with a parallel drive, which actuates the movement of the movable contact via a lever, which is pivotable by a fixed hub. The fixed hub 31 is located near the left end of the vertical lever, while the drive 32 is acting on the right end of the lever. The movable contact 33 is connected in the center of the lever in this example. Not shown is an opening spring, which is quite common in medium voltage switches or breakers. This spring drives the movable contact to the open position when it is released and holds the movable contact in this open position after the opening operation.

FIG. 1 shows the implementation of the invention in such, that a circuit breaker is provided with an additional pyrotechnical actuator or gas generator, additionally to the in FIG. 3 shown magnetic drive. In case the pyrotechnic actuator 6 ignites, the opening spring 2 drives the movable contact 33 to the open position by actuating main lever 3.

Figure 2:
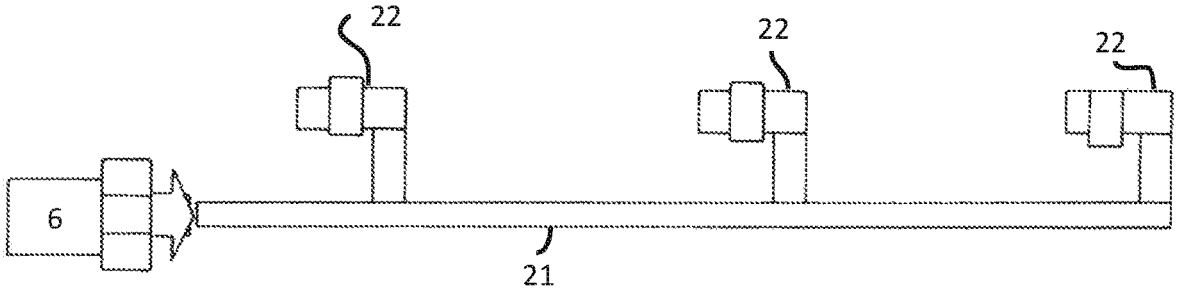
FIG. 2 shows a system with three phases.

FIG. 2 shows a system with three phases, which is quite common in medium voltage switches or breakers. The ignition of one pyrotechnic actuator 6 will drive a shaft 21 to the right. This shaft 21 was holding the hubs 22 of the three movable contacts in place. When the shaft 21 is moved to the right, all three hubs 22 are released so that the opening springs can drive all three movable contacts to the open position of the medium voltage switch or breaker.

Figure 4:
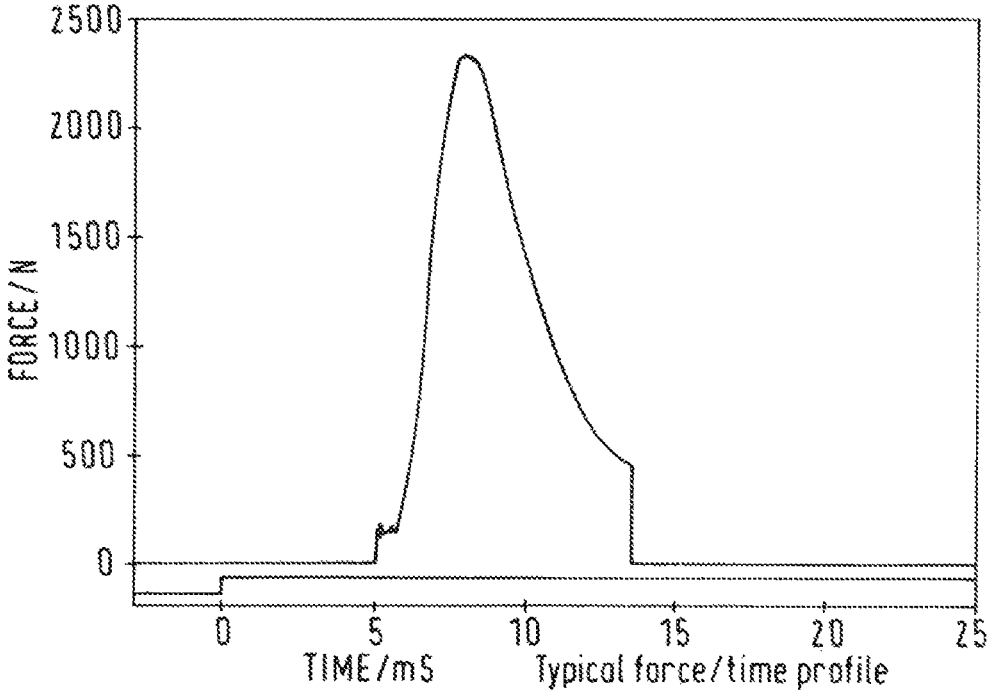
FIG. 4 shows the typical characteristics of the pyrotechnic actuator via the Force/Time function in a diagram.

FIG. 4 shows the typical characteristics of the pyrotechnic actuator via the Force/Time function in a diagram.

Several embodiments are possible and there are a lot of possibilities to perform this design as ADD ON to the standard circuit breaker with very few pieces. For example the pyrotechnic actuator can be used to remove a pivot of all the rods that, with a simple contribution of a spring, falls opening the circuit.

Additionally the pyrotechnic actuator allows monitoring the continuity of the injection winding leading to a real safe redundant mechanism.

Main functional features of the invention are:

Safe and independent trip mechanism

ADD ON Concept on the standard circuit breaker

After Safe Trip the circuit breaker standard functionalities are Recoverable acting with a procedure settling back pivots Recovery of safety open is possible replacing the pyrotechnic actuator.

One further improvement could be, the use of the gas generator instead of the pyrotechnic actuator.

The concept is the same but in this case the actuator can be a part of the kinematic design providing a more integrated and optimized embodiment. Additionally the use of the gas generator allows tuning the dimension of the expansion chamber and the piston in order to obtain an optimization of the force/stroke profile.

Another technology in order to have a "pyrotechnic based actuation" could be the nail gun concept.

Nail gun charges probably are not powerful enough to operate the interrupter but could be enough to be used as redundant trigger of a latched mechanical system. For this reason the Nail Gun gas power would be not a limitation because would be used as trigger.

In this invention it is supposed to act in the push road area by passing completely the standard actuator mechanism, this because is always the preferred option because is the most near area to the interrupter element, but in general the patent proposal could be extended at every element, for example the tripping coil and so on.

In this particular case could be more feasible to implement a solution like "Nail Gun gas generation concept" taking the benefit of multiple charges.

Anyway in the preferred design, acting near to the interrupter element as previously proposed, in order to have the breaker still working after a pyrotechnic tripping event it is necessary at least to rearm the standard mechanical condition, so an intervention would be needed in any case.

Basing on the considerations above the most probable embodiment for a "pyrotechnic based actuation" is the gas generators or pyrotechnic actuator not only due to the response power but also the ignition method.

Since the ignition method is electrical, it is much more compatible with MV systems of today.

The datasheet clearly define the current for continuity monitoring with 99.99% of probability of no ignition and the current with 99.99% of ignition, this feature allows both electrical ignition and continuity monitoring.

In these embodiments, the invention is supposed to act in the push road area by bypassing completely the standard actuator mechanism, this because it is the closest area to the interrupter element. Also in this case the gas generators or phyrotecnic actuator seems to be the most suitable technology to be used for a safe redundant TRIP function.

All the following working principles and functions are valid for one single pole module, and so there are three identical pyrotechnic backup tripping system in the circuit breaker, one for each pole.

Figure 5:
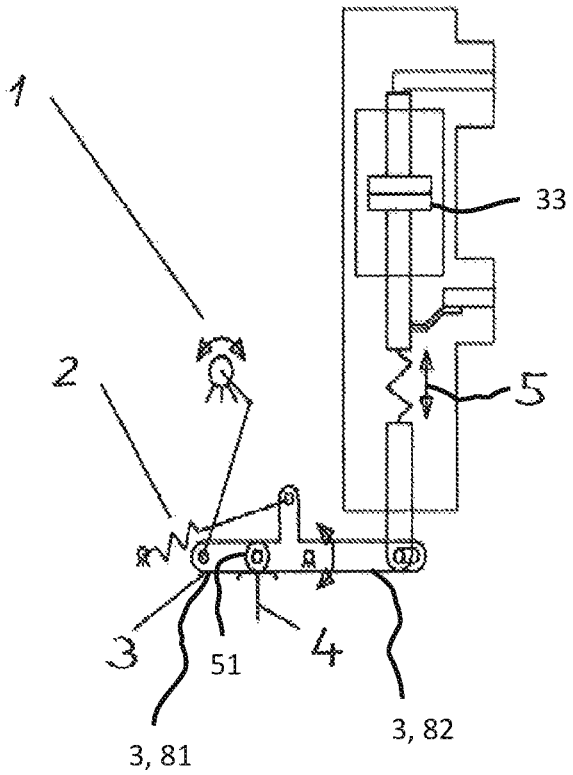
FIG. 5 shows, that the transmission main lever, which normally is a single solid body, is here divided into two parts connected by a pin and kept in relative rigid position by a latch.
Figure 8:
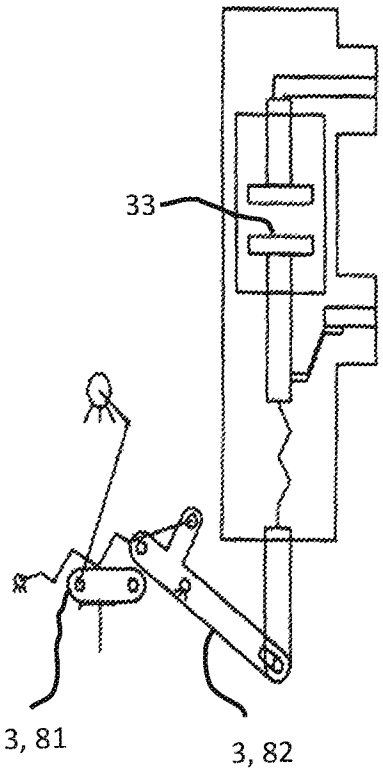
FIG. 8 shows the movement, generated by the opening springs and by the contact springs allows the moving contact of the poles to move in open position even if the mechanical or magnetic operating mechanism is not able to operate and does not allow to move the main shaft and the frontal part of the transmission lever, which so is kept in closed position even if the main contact of the circuit breaker are open.

FIGS. 5 and 8 show, that the transmission main lever 3, which normally is a single solid body, is here divided into two parts 81, 82 connected by a pin 51 and kept in relative rigid position by a latch 4.

In this way, the movement generated by rotation of the main shaft 1 (given by the mechanical or magnetic operating mechanism) is transmitted to the poles 33 and allows the opening and the closing operation during the normal functioning of the circuit breaker.

During the closing operation, the transmission levers 3 close the pole contacts 33 and compress the contact springs 5 inside the pushrods, which so are charged in closed position.

At the same time the opening spring 2 is charged during closing operation.

Figure 6:
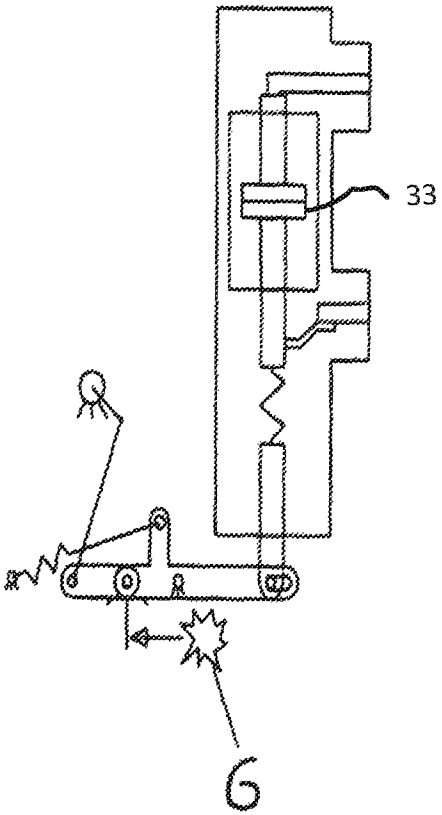
FIG. 6 shows, if the mechanical or magnetic operating mechanism is not able to perform a normal opening operation, the backup pyrotechnic opening system activates the pyrotechnic actuator or gas generator, which moves the latch that keeps the fontal and the back part of the transmission lever in relative rigid position, and so the two parts can have a relative motion.

FIG. 6 shows, if the mechanical or magnetic operating mechanism is not able to perform a normal opening operation, the backup pyrotechnic opening system activates the pyrotechnic actuator or gas generator, which moves the latch that keeps the fontal and the back part of the transmission lever in relative rigid position, and so the two parts can have a relative motion.

So the fontal cannot move because it is bounded to the operating mechanism rods and shaft, while the back part can rotate around the transmission fulcrum.

The back part of the transmission lever is connected to the pole pushrod, so its rotating movement allows the opening and closing operation of the main contacts.

When the pyrotechnic actuator or gas generator is activated the poles and the operating mechanism is in closed position, so the opening springs and the contact springs are charged, with mechanical potential energy stored in them.

Figure 7:
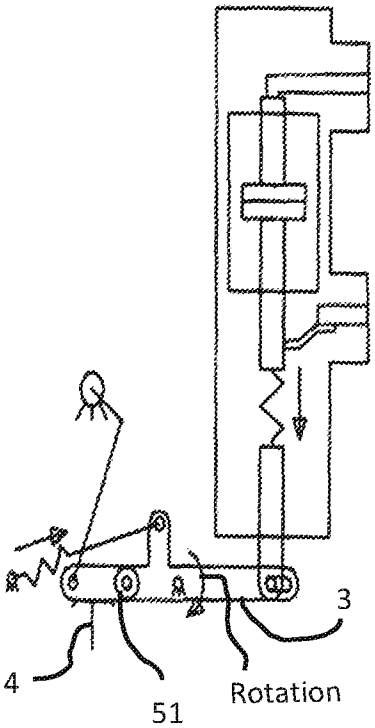
FIG. 7 shows, once the pyrotechnic actuator or gas generator has moved the latch between the two parts of the transmission lever, the charged opening springs and the charged contact springs move the back part of the transmission levers and make them rotate around the transmission fulcrum.

FIG. 7 shows, once the pyrotechnic actuator or gas generator has moved the latch between the two parts of the transmission lever, the charged opening springs and the charged contact springs move the back part of the transmission levers and make them rotate around the transmission fulcrum.

Finally FIG. 8 shows the movement, generated by the opening springs and by the contact springs allows the moving contact of the poles to move in open position even if the mechanical or magnetic operating mechanism is not able to operate and does not allow to move the main shaft and the frontal part of the transmission lever, which so is kept in closed position even if the main contact of the circuit breaker are open.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

NUMBERING

1 main shaft
2 opening spring
3 transmission main lever
4 latch
5 contact spring
6 pyrotechnic actuator, or gas generator

What is claimed is:

1. A medium voltage circuit switch or breaker, comprising:

at least one movable contact;

a fixed contact; and a mechanical or magnetical drive system, which is configured to move the at least one movable contact to a closed or opended position by a movement of a rod and/or a lever, the mechanical or magnetical drive system being linked to a switching generating signal, wherein the mechanical or magnetical drive system comprises at least one pyrotechnical actuator or gas generator, wherein the pyrotechnical actuator or the gas generator is linkable to the switching generating signal of the mechanical or magnetical drive system, and wherein the pyrotechnical actuator or the gas generator is driven as a redundant actuation system, such that in a logical unit, in case of detection of a malfunction of the mechanical or magnetical drive, the pyrotechnical actuator or the gas generator is ignited instead, as a redundant trip function.

2. The medium voltage circuit breaker according to claim 1, wherein an additional pyrotechnical actuator is limited on a pyrotechnical capsule with an extending mechanical element and a signal for ignition.

3. The medium voltage circuit breaker according to claim 1, wherein, in the logical unit are stored analytical data of a set of possible malfunctions of the mechanical or magnetical drive, in order to create dynamically adapted ignition signals for the pyrotechnical actuator or the gas generator.

4. The medium voltage circuit breaker according to claim 3, wherein the pyrotechnical actuator or the gas generator is arranged near the rod and/or lever, such that an expansion force vector of the pyrotechnical actuator or the gas generator is oriented in parallel to an actuation vector of the rod and/or lever.

5. The medium voltage circuit breaker according to claim 1, wherein the pyrotechnical actuator or the gas generator is sampled in a functional assembly, which is mountable directly on the medium voltage circuit breaker, by retrofit.

6. The medium voltage circuit switch or breaker according to claim 1, wherein the mechanical or magnetical drive system comprises the pyrotechnical actuator, the pyrotechnical actuator being configured to, upon ignition, cause the opening spring to drive the movable contact to the opened position.

7. The medium voltage circuit switch or breaker according to claim 1, wherein the at least one movable contact comprises multiple movable contacts including a first movable contact and a second movable contact and first and second fixed contacts are provided, wherein the mechanical or magnetical drive system comprises the at least one pyrotechnical actuator, wherein the pyrotechnical actuator is configured such that, upon ignition, the pyrotechnical actuator causes the first movable contact to release from the first fixed contact and the second movable contact to release from the second fixed contact.

8. The medium voltage circuit switch or breaker according to claim 1, wherein the mechanical or magnetical drive system comprises a pin and a latch, wherein the opening spring is configured to drive the movable contact to the open position upon being released by rotating the pin, and wherein the latch is configured to oppose the bias exerted by the opening spring to maintain the pin in a stable position.

9. The medium voltage circuit switch or breaker according to claim 8, wherein the mechanical or magnetical drive system comprises the at least one pyrotechnical actuator, which is configured to, upon ignition, destabilize the latch and thereby release the opening spring.

10. The medium voltage circuit switch or breaker according to claim 1, wherein the mechanical or magnetical drive system comprises a contact spring, the rod, and the lever, and wherein the contact spring is configured to, upon release, push the rod to destabilize the lever.

11. The medium voltage circuit switch or breaker according to claim 10, wherein the rod and the lever are pivotably connected.

12. A method of operating a medium voltage circuit breaker having at least one movable contact, a fixed contact, and a mechanical or magnetical drive system, the method comprising:

using the mechanical or magnetical drive system to move the movable contact to a closed or open position by moving a rod and/or a lever;

linking the mechanical or magnetical drive system to a switching generating signal;

providing the mechanical or magnetical drive system with at least one pyrotechnical actuator or gas generator and an opening spring, the opening spring being configured to drive the movable contact to the opened position upon being released; and linking the pyrotechnical actuator or the gas generator to the switching generating signal of the mechanical or magnetical drive system;

wherein the pyrotechnical actuator or the gas generator is driven as a redundant actuation system, such that in a logical unit, in case of detection of a malfunction of the mechanical or magnetical drive, the pyrotechnical actuator or the gas generator is ignited instead, as a redundant trip function.

13. The method according to claim 12, wherein an additional pyrotechnical actuator is limited on a pyrotechnical capsule with an extending mechanical element and a signal for ignition.

14. The method according to claim 12, wherein, in the logical unit are stored analytical data of a set of possible malfunctions of the mechanical or magnetical drive, in order to create dynamically adapted ignition signals for the pyrotechnical actuator or the gas generator.

15. The method according to claim 12, wherein the pyrotechnical actuator or the gas generator is arranged near the rod and/or lever, such that an expansion force vector of the pyrotechnical actuator or the gas generator is oriented in parallel to an actuation vector of the rod and/or lever.

* * * * *